US010978247B2

(12) United States Patent
Song et al.

(10) Patent No.: US 10,978,247 B2
(45) Date of Patent: Apr. 13, 2021

(54) DEPOSITION SYSTEM FOR WINDING OF LARGE-SCALE SUPERCONDUCTING MAGNET COILS

(71) Applicant: HEFEI INSTITUTES OF PHYSICAL SCIENCE, CHINESE ACADEMY OF SCIENCES, Anhui (CN)

(72) Inventors: Yuntao Song, Anhui (CN); Wei Wen, Anhui (CN); Kun Lu, Anhui (CN); Guang Shen, Anhui (CN); Jing Wei, Anhui (CN)

(73) Assignee: HEFEI INSTITUTES OF PHYSICAL SCIENCE, CHINESE ACAD, Hefei (CN)

( * ) Notice: Subject to any disclaimer, the term of this patent is extended or adjusted under 35 U.S.C. 154(b) by 0 days.

(21) Appl. No.: 17/031,614

(22) Filed: Sep. 24, 2020

(65) Prior Publication Data

US 2021/0020361 A1 Jan. 21, 2021

Related U.S. Application Data

(63) Continuation of application No. PCT/CN2019/105985, filed on Sep. 16, 2019.

(30) Foreign Application Priority Data

Nov. 5, 2018 (CN) ..... 201811306997.8

(51) Int. Cl.
*H01F 41/04* (2006.01)
*H01F 6/06* (2006.01)

(52) U.S. Cl.
CPC ..... *H01F 41/048* (2013.01); *H01F 6/06* (2013.01)

(58) Field of Classification Search
CPC ..... H01F 41/048; H01F 6/06
See application file for complete search history.

(56) References Cited

U.S. PATENT DOCUMENTS

| | | | | |
|---|---|---|---|---|
| 2017/0050230 | A1* | 2/2017 | Lee | B21D 51/2607 |
| 2017/0104381 | A1* | 4/2017 | Batz | H01F 6/06 |
| 2018/0061541 | A1* | 3/2018 | Araki | C04B 35/624 |

FOREIGN PATENT DOCUMENTS

| | | | |
|---|---|---|---|
| CN | 102315014 | A | 1/2012 |
| CN | 108597850 | A | 9/2018 |
| CN | 108597859 | A | 9/2018 |
| CN | 109411227 | A | 3/2019 |
| JP | 2013004873 | A | 1/2013 |
| JP | 2013197563 | A | 9/2013 |

* cited by examiner

*Primary Examiner* — Paul A Wartalowicz

(57) ABSTRACT

A deposition system for winding of a large-scale superconducting magnet coil. First and second conductor supports withstand the weight of a bent conductor and allow the conductor to be lowered down in spiral and be placed smoothly onto a rotary table. The rotary table bears the weight of coils, rotates according to a contour of the coil and forwarding speed of the conductor, and tracks the winding trajectory of the coil accurately, which avoids the extra stress induced onto the conductor. The conductor placed on the rotary table is reliably clamped by clamping fixtures and adjustable rod to ensure the conductors to be placed on correct radial and toroidal positions. After treated by the deposition system, the conductor is placed to a corresponding position on the rotary table smoothly and accurately to achieve a high-precision contour control of the coil.

6 Claims, 4 Drawing Sheets

DEPOSITION SYSTEM FOR WINDING OF LARGE-SCALE SUPERCONDUCTING MAGNET COILS

CROSS-REFERENCE TO RELATED APPLICATIONS

This application is a continuation of International Application No. PCT/CN2019/105985, filed on Sep. 16, 2019, which claims the benefit of priority from Chinese Patent Application No. 201811306997.8, filed on Nov. 5, 2018. The content of the aforementioned applications, including any intervening amendments thereto, are incorporated herein by reference.

TECHNICAL FIELD

This application relates to the production of superconducting magnet coils of large-scale thermonuclear fusion devices or other large-scale electromagnetic devices, and more particularly to a deposition system for winding of a large-scale superconducting magnet coil.

BACKGROUND OF THE DISCLOSURE

Thermonuclear fusion is a sustainable and clean energy source, and there is a plan to set up the International Thermonuclear Experimental Reactor (ITER) within the next ten years. The required magnetic field is provided by superconducting magnet coils in a Tokamak to control and confine high-temperature plasma. The winding of coils which ensures the dimensions of coils is significant for the production of the superconducting magnet coils. Generally, the large-scale superconducting magnet coils are wound by using the strain-free multi-pancakes configuration. In this configuration, the winding is performed from the outer radius to the inner radius "outside-in" for the first pancake, and from the inner radius to the outer radius "inside-out" for the second pancake. The above steps are repeated until the winding of multi-pancake coils is completed. Turn-to-turn joggles are needed in each pancake to accomplish the proper positioning of the conductor during winding, as well as a joggle to make the transition from one pancake to the next. During the winding of coils, conductors are forwarded and bent through a bending machine, and each turn of the bent conductor is placed through a deposition system at a specific position on the rotary table smoothly and accurately, ensuring a high precision of coil dimensions after the winding. Therefore, as an important part of the winding superconducting magnet coils, the deposition system is required to withstand the weight of the coils, and ensure the conductors to be placed at specific position on the rotary table smoothly and accurately. Moreover, the rotary table is also functioning at tracking the winding trajectory, to avoid extra stress induced on the conductors.

SUMMARY OF THE DISCLOSURE

An objective of the disclosure is to provide a deposition system for winding of a large-scale superconducting magnet coil to overcome the technical defects in the prior art.

The disclosure is achieved by adopting the following technical solutions.

The disclosure provides a deposition system for winding of a large-scale superconducting magnet coil, comprising:

a rotary table which is annular; wherein a gantry frame is located across inner and outer sides of the rotary table in a radial direction; a bending head is mounted on the gantry frame; a first conductor support and a second conductor support are respectively located at an angular position of 30° and 120°, relative to a center line of the gantry frame, in a clockwise direction;

a set of external winding moulds are spaced apart on an outer circumference of the rotary table; a set of internal winding moulds are spaced apart on an inner circumference of the rotary table; a first main clamping fixture is mounted on each of the external winding moulds; a second main clamping fixture is mounted on each of the internal winding moulds;

an adjustable rod is applied to work together with the second main clamping fixture; and a set of auxiliary clamping fixtures are located on both (miter and inner circumferences of the rotary table, respectively.

In some embodiments, the first conductor support and the second conductor support each have a gantry structure and comprise two support columns which are adjustable in height; a roller which is made of nylon is mounted on a top of the gantry structure to take the weight of one turn conductor.

In some embodiments, the internal winding moulds and the external winding moulds are L-shaped structures.

In some embodiments, the auxiliary clamping fixtures are clamping blocks arranged along a radial direction of the rotary table, and the clamping is achieved by removing or adding the clamping blocks.

In some embodiments, the first main clamping fixture and the second main clamping fixture have a similar structure, and comprise a support base and toggle clamp, respectively; the first main clamping fixture is connected and fixed with the external winding moulds by bolts, and the second main clamping fixture is connected and fixed with the internal winding moulds by bolts.

In some embodiments, one end of the adjustable rod is contacted with a conductor, while the other end of the adjustable rod is contacted with the toggle clamp of the second main clamping fixtures; and the adjustable rod achieves forward and backward movements through an adjustable bolt of the toggle clamp.

The first conductor support and the second conductor support withstand the weight of a conductor after bending, allow the conductor to be lowered down in spiral and be placed smoothly onto the rotary table. The rotary table bears the weight of the coils, rotates according to the contour of the coils and forwarding speed of the conductor, and tracks the winding trajectory accurately to avoid extra stress induced onto the conductor. The external and internal winding moulds limit the coils and ensure precise dimension after the winding. The conductor placed on the rotary table is properly clamped by the first main clamping fixture, the second main clamping fixture, and the adjustable rod to achieve correct radial and toroidal positions. The auxiliary clamping fixtures allow the outermost and innermost turns of conductor to enter the external and internal winding moulds smoothly. With the deposition system, each turn of the conductor is properly located at a specific position, which results in high-precision contour control of the coils.

The deposition system of the disclosure works at room temperature, and is applicable for the strain-free winding of large-scale superconducting magnet coils. The deposition system of the disclosure has a preferable application prospect in fabrication of superconducting magnet coils in fusion reactor facilities.

The disclosure has the following beneficial features.

The disclosure has a simple principle and structure to achieve complicate functions. With this deposition system, each turn of the conductor is placed into the external and internal winding moulds smoothly and properly, resulting in high precision contour control of the coils. Various functions are realized by different components of the disclosure. The conductor supports withstand the weight of the conductor and allow the conductor to be placed onto the rotary table smoothly. The rotary table bear the weight of the coils and tracks the winding trajectory. The external and internal moulds play the role of high precision contour control of the coils. The clamping fixtures properly clamp each turn of the conductor to achieve accurate radial and toroidal conductor positioning.

DETAILED DESCRIPTION OF EMBODIMENTS

Figure 1:
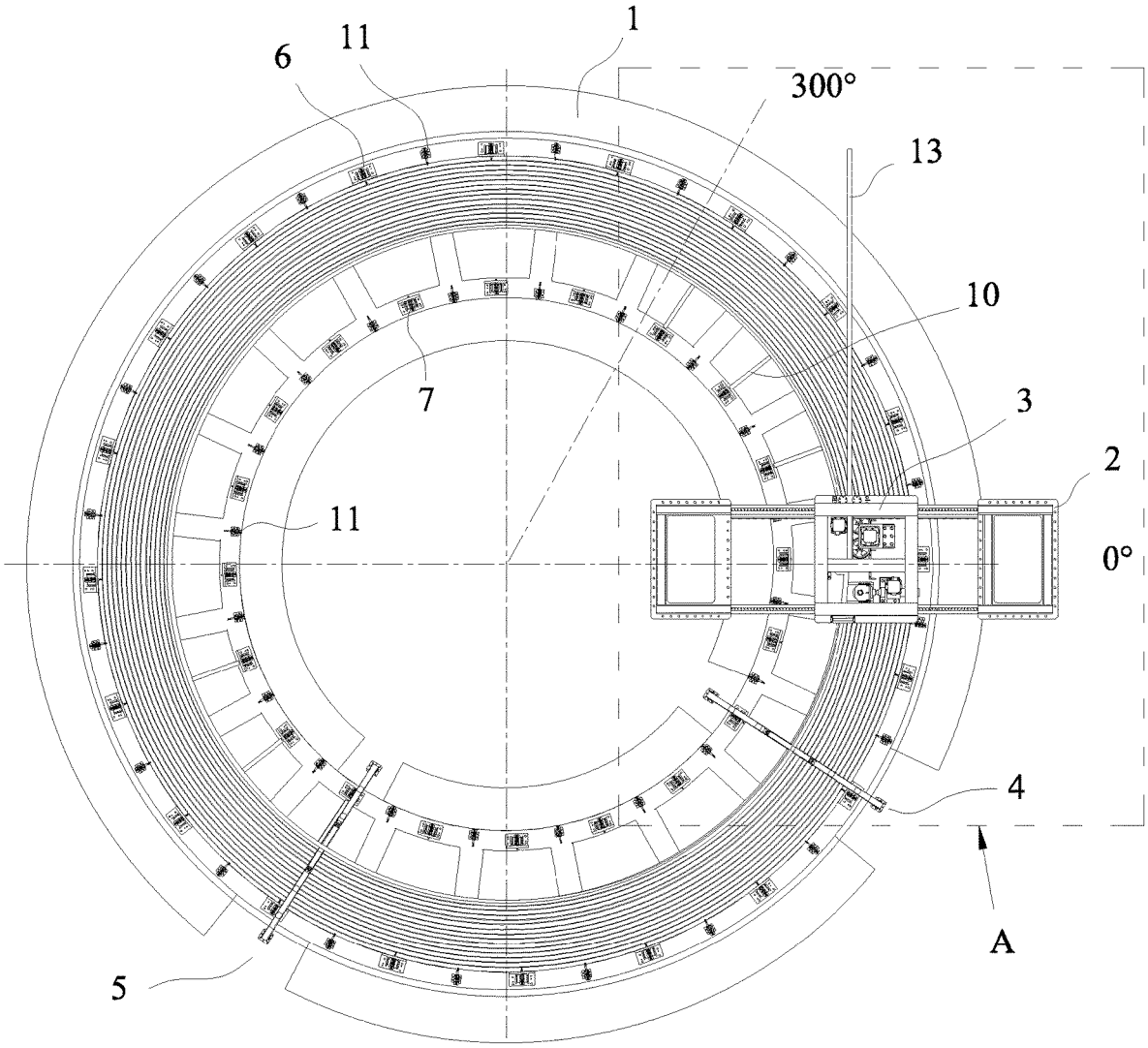
FIG. 1 is a top view of a deposition system for winding of a large-scale superconducting magnet coil according to an embodiment of the present disclosure.
Figure 2:
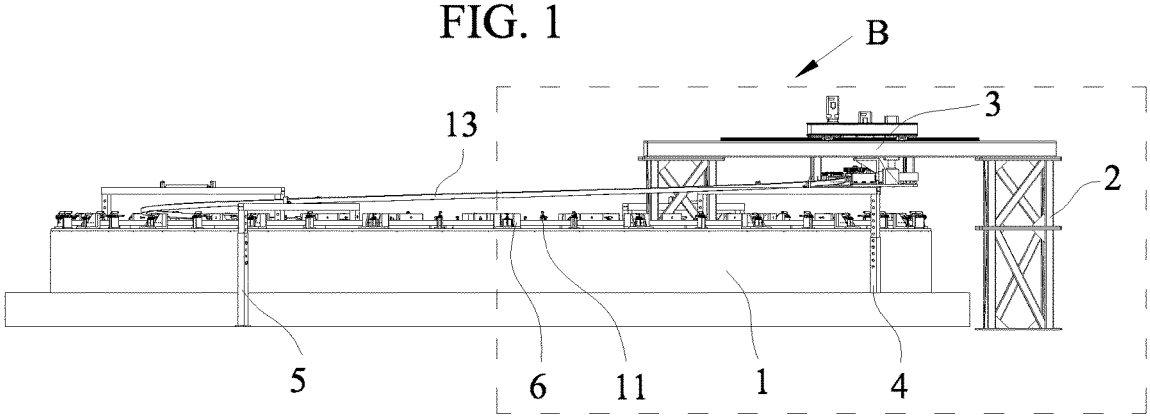
FIG. 2 is a side view of the deposition system according to an embodiment of the present disclosure.
Figure 3:
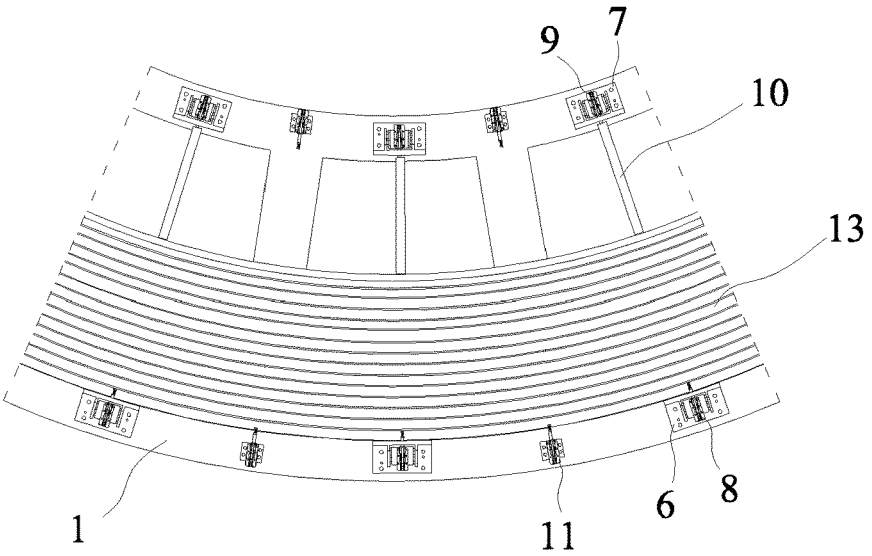
FIG. 3 is a partial enlarged top view of the deposition system according to an embodiment of the present disclosure.

As shown in FIGS. 1-3 and 5-7, the embodiment provides a deposition system for winding of a large-scale superconducting magnet coil, including: a rotary table 1 which is annular. A gantry frame 2 is located across inner and outer sides of the rotary table in a radial direction; a bending head 3 is mounted on the gantry frame 2; a first conductor support 4 is provided crossing the inner and (miter sides of the rotary table 1 at an angular position of 30° in a clockwise direction, relative to a center line of the gantry frame 2; a second conductor support 5 is provided crossing inner and (miter sides of the rotary table 1 at an angular position of 120° in a clockwise direction, relative to the center line of the gantry frame 2.

A set of external winding moulds 6 spaced apart are provided bolting on the outer circumference of the rotary table 1; a set of internal winding moulds 7 spaced apart are provided bolting on the inner circumference of the rotary table 1; a first main clamping fixture is provided bolting on the external winding moulds; a second main clamping fixture is provided bolting on the internal winding moulds.

An adjustable rod 10 is provided contacting with the second main clamping fixture 7; a set of auxiliary clamping fixtures 11 spaced apart are provided bolting on the inner and external circumferences of the rotary table 1, respectively.

In some embodiments, the first conductor support 4 and second conductor support 5 each have a gantry structure and include two height adjustable columns. A roller made of nylon is mounted on the top of the gantry structure to take the weight of a conductor.

Figure 4:
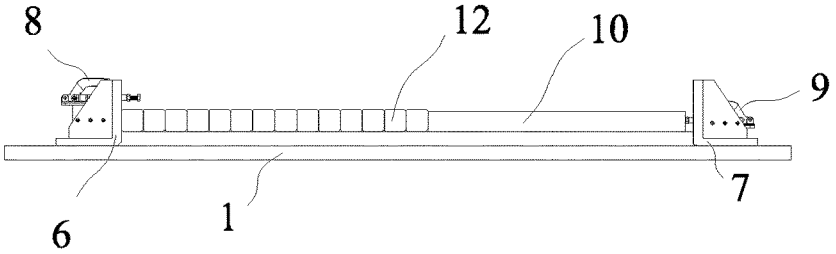
FIG. 4 is a partial enlarged side view of the deposition system according to an embodiment of the present disclosure.

As shown in FIG. 4, the external winding moulds 6 and the internal winding moulds 7 are L-shaped plates.

As shown in FIG. 4, the auxiliary clamping fixtures 11 are clamping blocks 12 arranged along a radial direction of the rotary table 1, and the clamping is achieved by removing or adding the clamping blocks 12.

Figure 5:
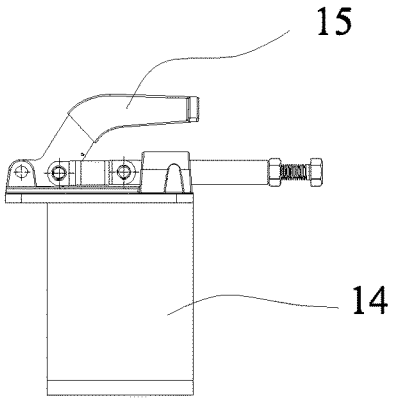
FIG. 5 is a schematic diagram of a main clamping fixture of the deposition system according to an embodiment of the present disclosure.
Figure 6:
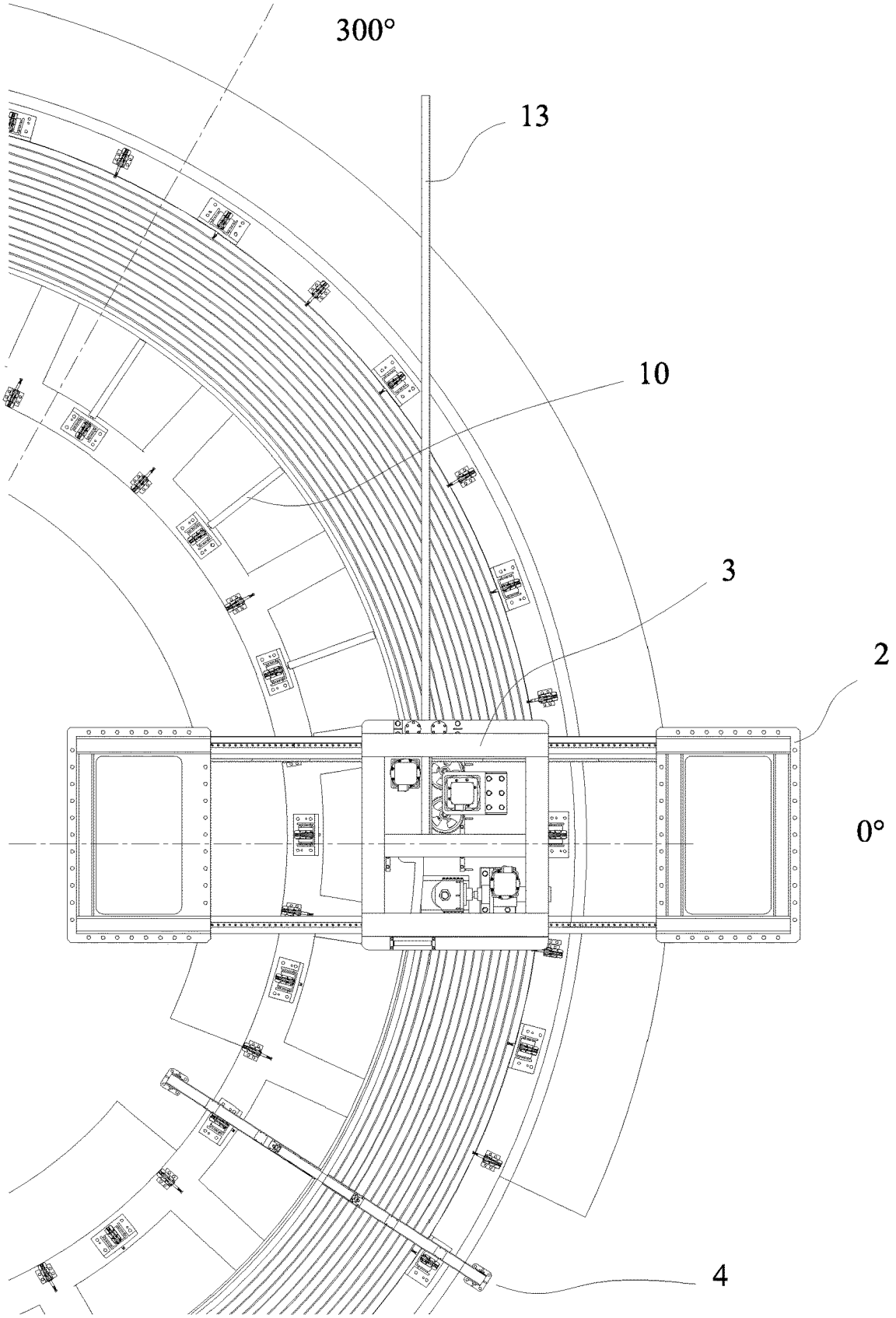
FIG. 6 is an enlarged view of portion A in FIG. 1.
Figure 7:
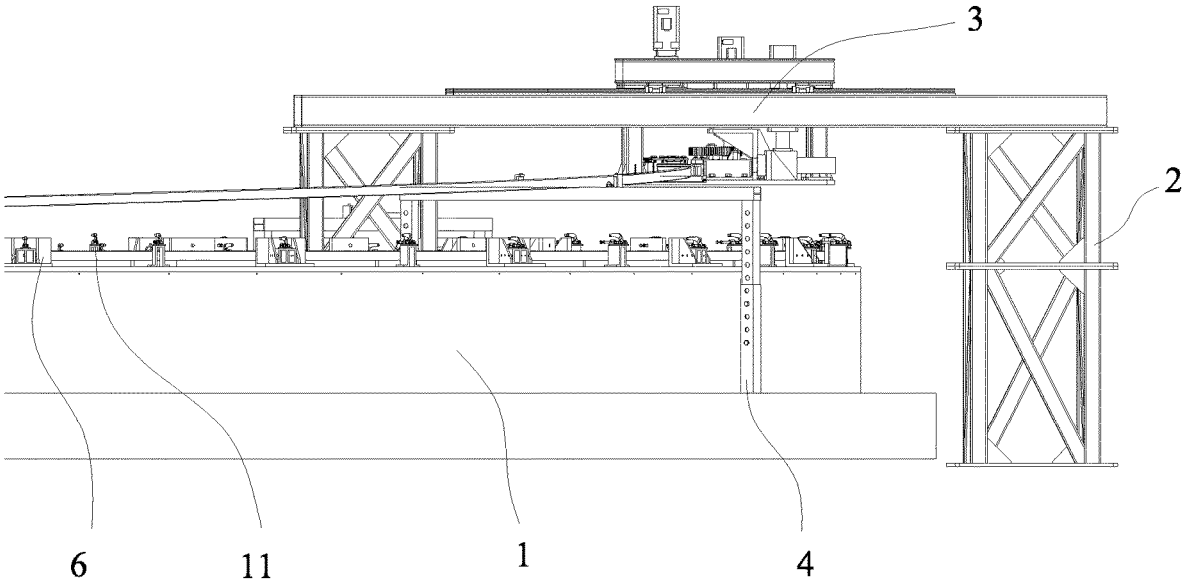
FIG. 7 is an enlarged view of portion B in FIG. 2.

As shown in FIG. 5, the first main clamping fixture 8 and the second clamping fixture 9 have a similar structure, and include a support base 14 and a toggle clamp 15 fixed on the support base 14, respectively. The first main clamping fixture 8 is bolted on the external winding moulds 6, and the second main clamping fixture 9 is bolted on the internal winding moulds 7.

In some embodiments, one end of the adjustable rod 10 is contacted with the toggle clamp of the second main clamping fixture 9 via an adjustable bolt of the toggle clamp. The adjustable rod 10 achieves forward and backward movements through an adjusting bolt of the toggle clamp.

During the winding of coils, a conductor 13 is bent through the bending head 3, and each torn of the bent conductor 13 is reliably placed through the deposition system, achieving a high-precision contour control of the coils.

The rotary table 1 withstands the weight of coils and rotates according to the contour of the coils and forwarding speed of the conductor 13 to track the winding trajectory of the coils accurately and avoid extra stress induced onto the conductor 13 during the molding. The external winding moulds 6 and the internal winding moulds 7 are made of stainless steel and have high-precision contours. The external winding moulds 6 and the internal winding moulds 7 are connected to the rotary table 1 via bolts and realize an accurate positioning through cylindrical pins, ensuring a required coil contour of the wound coils.

The first main clamping fixture 8 is provided on each of the external winding moulds 6; and the second main clamping fixture 9 is provided on each of the internal winding moulds 7. The conductor 13 placed on the rotary table 1 is reliably clamped by the first main clamping fixture 8, the second main clamping fixture 9 and the adjustable rod 10, which ensures the conductor 13 to be placed on correct radial positions. The auxiliary clamping fixtures 11 allow the conductor 13 of the outermost and innermost turns to enter the inner and external winding moulds smoothly.

Taking the winding of the coils in a first layer as an example, the bent conductor 13 is treated by the deposition system according to the following steps.

1) The rotary table 1 rotates clockwise according to a contour of the coils and a forwarding speed of the conductor 13 to track the winding trajectory of the coils.

2) The first conductor support 4 and the second conductor support 5 withstand the weight of the conductor 13 and allow the conductor 13 to be lowered down in spiral and be placed smoothly onto the rotary table 1.

3) When a bent section of the conductor 13 arrives at an angular position of 300°, relative to a center line of the gantry frame 2, in a clockwise direction on the rotary table 1, the conductor starts to be deposited. The second main clamping fixture 9 and the adjustable rod 10 are adjusted to reliably clamp a first turn of the conductor 13 with the external winding moulds 6. A first space between the conductor 13 and the external winding moulds 6 is measured via a feeler gauge, and is ensured to be not more than 0.2 mm.

4) The conductor 13 is fed continually till the deposition of the first turn of the conductor 13 is completed.

5) The conductor 13 is fed continually. The second main clamping fixture 9 and the adjustable rod 10 are adjusted to reliably clamp a second turn of the conductor 13 with the first turn of the conductor 13 and the external winding moulds 6. A second space between the second turn of the conductor 13 and the external winding moulds 6 is measured via a vernier caliper, and a deviation between the second space and a theoretical dimension is ensured to be not more than 0.5 mm.

6) The conductor 13 is fed continually. The second main clamping fixture 9 and the adjustable rod 10 are adjusted to reliably clamp an nth turn of the conductor 13 with a (n−1)th turn of the conductor 13 and the external winding moulds 6. An nth space between the nth turn of the conductor 13 and the external winding moulds 6 is measured by the vernier caliper, and a deviation between the nth space and a theoretical dimension is ensured to be not more than 0.5 mm.

7) Step 6 is repeated till the last turn of the conductor 13 in the first layer starts to be deposited.

8) The internal winding moulds 7 are disassembled gradually.

The conductor 13 is fed continually. The auxiliary clamping fixtures 11 at the inner circumference of the rotary table are adjusted to reliably clamp the last torn of the conductor 13 with the deposited turns of the conductors 13 and the external winding moulds 6. The internal winding moulds 7 are assembled gradually until the last turn of the conductor 13 in the first layer is deposited and all the internal winding moulds 7 are assembled completely. The winding of the coils in the first layer is ended.

The technical solutions of the present disclosure can be used for reference as long as a high-precision molding process of each turn of the conductor 13 is expected during the winding of coils. Any simple modification or equivalent variation made without departing from the spirit of the present disclosure should fall within the scope of the disclosure.

What is claimed is:

1. A deposition system for winding of a large-scale superconducting magnet coil, comprising: a rotary table which is annular;

wherein a gantry frame is located across inner and outer sides of the rotary table in a radial direction of the rotary table; a bending head is mounted on the gantry frame;

a first conductor support is at 30 degrees in a clockwise direction, relative to a center line of the gantry frame; and a second conductor support is at 120 degrees in a clockwise direction, relative to the center line of the gantry frame;

a set of external winding moulds are spaced apart on an outer circumference of the rotary table; a set of internal winding moulds are spaced apart on an inner circumference of the rotary table; a first main clamping fixture is provided on each of the external winding moulds; a second main clamping fixture is provided on each of the internal winding moulds; and an adjustable rod is provided to work together with the second main clamping fixture; and a plurality of auxiliary clamping fixtures spaced apart are provided on the inner and outer circumferences of the rotary table, respectively.

2. The deposition system of claim 1, wherein the first conductor support and the second conductor support each have a gantry structure and each comprise two support columns which are adjustable in height; and a roller which is made of nylon is mounted on a top of the gantry structure to take the weight of a conductor.

3. The deposition system of claim 1, wherein the internal winding moulds and the external winding moulds are L-shaped structures.

4. The deposition system of claim 1, wherein the auxiliary clamping fixtures are a plurality of clamping blocks arranged along the radial direction of the rotary table.

5. The deposition system of claim 1, wherein the first main clamping fixture and the second clamping fixture have a similar structure, and each comprise a support base and a toggle clamp; the first main clamping fixture is fixed on each of the external winding moulds via a bolt, and the second main clamping fixture is fixed on each of the internal winding moulds via a bolt.

6. The deposition system of claim 5, wherein one end of the adjustable rod is contacted with a conductor, and the other end of the adjustable rod is contacted with the toggle clamp of the second main clamping fixture through an adjusting bolt of the adjustable toggle.

* * * * *